US012371893B2

(12) United States Patent
Day, Sr.

(10) Patent No.: US 12,371,893 B2
(45) Date of Patent: Jul. 29, 2025

(54) LOAD BEARING ARCH

(71) Applicant: Jesse C. Day, Sr., Astoria, OR (US)

(72) Inventor: Jesse C. Day, Sr., Astoria, OR (US)

( * ) Notice: Subject to any disclaimer, the term of this patent is extended or adjusted under 35 U.S.C. 154(b) by 252 days.

(21) Appl. No.: 18/235,489

(22) Filed: Aug. 18, 2023

(65) Prior Publication Data

US 2025/0059755 A1 Feb. 20, 2025

(51) Int. Cl.
*E04B 1/30* (2006.01)
*E04B 1/32* (2006.01)

(52) U.S. Cl.
CPC . *E04B 1/30* (2013.01); *E04B 1/32* (2013.01)

(58) Field of Classification Search
CPC ..... E04B 1/30; E04B 1/32; E04C 3/44
See application file for complete search history.

(56) References Cited

U.S. PATENT DOCUMENTS 1,412,096 A * 4/1922 Von Emperger ..... E04C 3/34 52/649.3
2,499,478 A * 3/1950 Feser ..... E04B 1/32 160/90
2,894,527 A * 7/1959 Riley ..... E01D 18/00 137/236.1
3,378,965 A * 4/1968 Broquist ..... E04C 3/44 52/223.7
4,094,110 A * 6/1978 Dickens ..... E04B 1/3505 52/444
4,563,107 A * 1/1986 Peterson ..... E01D 4/00 405/157
4,831,792 A * 5/1989 Berger ..... E04B 1/32 52/6
5,218,801 A * 6/1993 Hereford ..... E04B 7/022 52/693
5,252,002 A * 10/1993 Day ..... E01F 5/005 405/126
2018/0155928 A1* 6/2018 Hohmann, Jr. ..... E04C 3/02

FOREIGN PATENT DOCUMENTS

CN 112064852 A * 12/2020 ..... E04B 5/43

* cited by examiner

*Primary Examiner* — Patrick J Maestri
(74) *Attorney, Agent, or Firm* — The Rapacke Law Group, P.A.; Andrew Rapacke

(57) ABSTRACT

A load bearing arch is disclosed, including a lower arch and an upper arch separated by a first beam and a second beam. Interior foam is provided between the lower arch and the upper arch, and a tension cable extends above the lower arch and between the first beam and the second beam. One or more levelling plates are positioned at a top of the upper arch. One or more plate ties extend vertically between the lower arch and the upper arch.

17 Claims, 1 Drawing Sheet

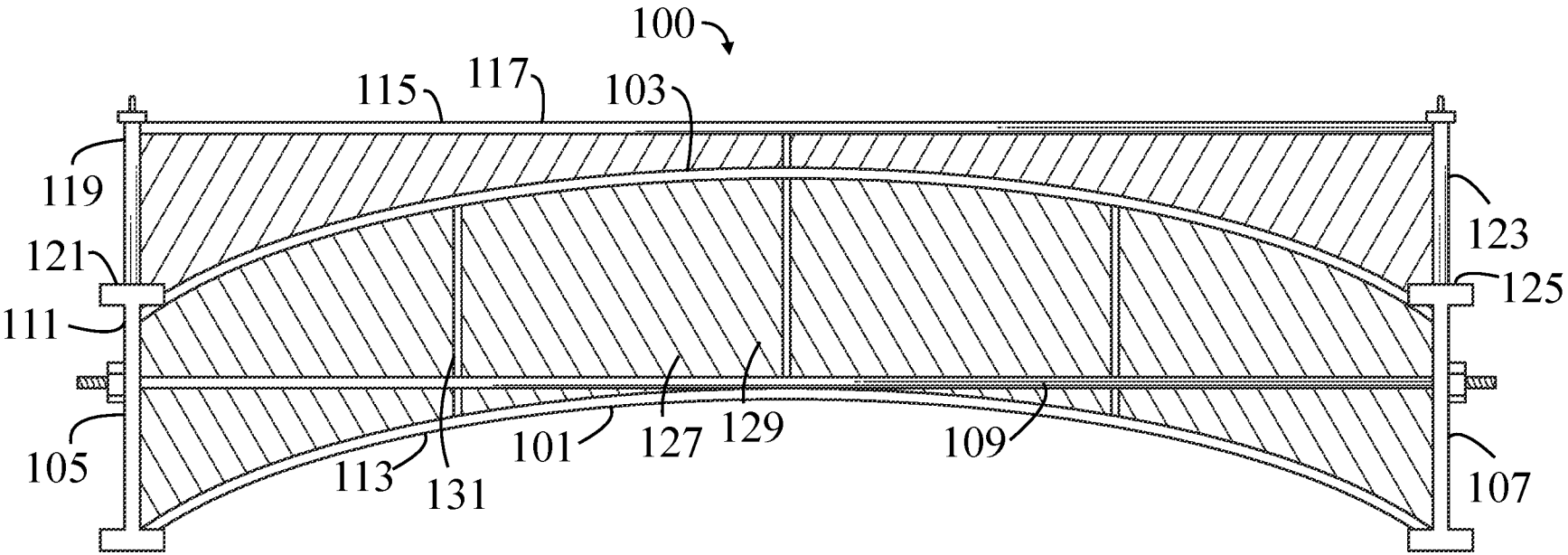
100
103
117
115
119
121
111
105
113
131
101
127
129
109
123
125
107

LOAD BEARING ARCH

TECHNICAL FIELD

Embodiments of the invention relate to construction elements and more particularly to load bearing arches.

BACKGROUND

Reinforced and prestressed concrete beam structures are commonly used in construction of buildings and bridges. These structures are exceedingly heavy and made of concrete which is inherently difficult to repair if damaged. If moved and dropped any distance in actions such as an earthquake or an accident they are no longer useable and must be replaced. In the current arts, there are no comparable structures for military use other than hand constructed bridges.

SUMMARY OF THE INVENTION

This summary is provided to introduce a variety of concepts in a simplified form that is disclosed further in the detailed description of the embodiments. This summary is not intended for determining or limiting the scope of the claimed subject matter.

The embodiments provided herein relate to a load bearing arch is disclosed, including a lower arch and an upper arch separated by a first beam and a second beam. Interior foam is provided between the lower arch and the upper arch, and a tension cable extends above the lower arch and between the first beam and the second beam. One or more levelling plates are positioned at a top of the upper arch. One or more plate ties extend vertically between the lower arch and the upper arch.

The load bearing arch extends across large openings and supports loads of weight of a structure. The load bearing arch is significantly lighter than present reinforced concrete floors used in construction of multi-level buildings. The invention replaces present prestressed concrete beams with a lighter and repairable structure that may be earthquake resistant.

The load bearing arch is much lighter in weight than concrete structures and is sufficiently strong to survive a major earthquake or accident. Further, the load bearing arch is repairable if dislodged from its structural supports. The load bearing arch is also less likely to fail or pancake down if used as a floor structure during a major earthquake. The embodiments of the load bearing arch may be pre-made before a construction and could be standardized as a construction unit, speeding up construction significantly.

In one aspect, the one or more plate ties resist the movement of either plate away from the interior foam.

In one aspect, the interior foam is comprised of a plurality of hollow tubes to allow the passing of a utility.

In one aspect, the lower arch forms a bottom of the load bearing arch.

In one aspect, the embodiments include a first beam end plate positioned on the first beam and a second beam end plate positioned on the second beam.

In one aspect, the first and the second beam end plate include an arch shaped cross sections and are disposed at a constant distance from each other.

In one aspect, the embodiments include a first beam extension selectively extending from a first upper surface of the first beam and a second beam extension selectively extending from a second upper surface of the second beam.

BRIEF DESCRIPTION OF THE DRAWINGS

A complete understanding of the present embodiments and the advantages and features thereof will be more readily understood by reference to the following detailed description when considered in conjunction with the accompanying drawings wherein:

FIG. 1 illustrates a side elevation view of the load bearing arch, according to some embodiments.

DETAILED DESCRIPTION

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided here relate to a load bearing arch which extends across large openings and supports loads of weight of a structure. The load bearing arch is significantly lighter than present reinforced concrete floors used in construction of multi-level buildings. The load bearing arch can replace present prestressed concrete beams with a lighter and repairable structure that may be earthquake resistant. The load bearing arch may also be used by the military as a stream or large opening (i.e., tank trap) or used as a module in creation of a quick construction safety bunker.

FIG. 1 illustrates the load bearing arch 100 in an exemplary embodiment. The load bearing arch includes a lower arch 101 and an upper arch 103 positioned above the lower arch 101 separated by a first beam 105 and a second beam 107. One or more tension cables 109 are positioned between the first beam 105 and the second beam 107 and provide tension to the load bearing arch 100. One or more beam end plates 111 are coupled to the first beam 105 and/or the second beam 107. The lower arch 101 forms the bottom 113 of the load bearing arch 100. One or more leveling plates 115 are positioned at the top 117 of the load bearing arch 100 and are used if the top 117 surface should be levelled on site. A first beam extension 119 extends from the upper surface 121 of the first beam 105 and a second beam extension 123 extends from a second upper surface 125 of the second beam 107. The void 127 between the lower arch 101 and the upper arch 103 may be filled with foam 129. Plate ties 131 are provided between the upper arch 103 and lower arch 101 and extend through the void 133 (or interior foam).

In some embodiments, each of the first beam extension 119 and second beam extension 123 are selectively extendable to the desired height of the load bearing arch 100.

The load bearing arch is comprised of a composite material and includes a pair of metal beam end plates that have an arch shaped cross sections and are disposed at a constant distance from each other. These beam end plates are separated by a core material (e.g., a high density polyurethane foam). One skilled in the arts will readily understand that other foam mixtures maybe used depending on the applications and structure needs. Each plate is held together by the first and/or second beams having a channel or I-beam. The top and bottom members of the first and second beams are disposed above and below the composite arch's metal plates respectively, to hold them together.

The load bearing arch's plates preferably are sections of large radius, steel arch plate, and may be corrugated. Although the arch plate may be corrugated, it is to be recognized that other forms of plate maybe used without departing from the principles of the embodiments described herein. The load bearing arch may have cross ribs of or ties between the top and bottom plate to resist the movement of either plate away from the internal foam core at an as needed spacing.

The load bearing arch may include a plurality of tension cables that are disposed along the midpoint of the end beams for the end beams to be connected using a plurality of respective bolts. The cables are preferably attached at regular intervals along the end beams. The tension cables assist the composite arch in resisting separation of the end beams and deflection and collapse of the arch structure.

A leveling layer may be added to the top of the load bearing arch using a similar flat plate of metal the same length as the composite arch without the radius. This plate would be attached at the highest point of the top arch mid-point with bolts or other connecting material and to the extended end plates on either end of the composite arch.

The void on either end of the area under the flat plate and the composite arch plate may be filled with similar foam material as that used in the composite arch construction. The interior foam may have hollow tubes passing through it to allow the passing of utilities from one side to the other of the arch. The interior foam may also have added components such as hollow balls made of recycled plastic, packets of expanding glue (i.e., Gorilla Glue) could be scattered throughout the foam so that if the structure were damaged by bullet or bomb fragments the interior foam could self-repair. A layer of "Kevlar" could be included in the interior of the foam to resist penetration of bullets or bomb fragments if used by the military as bunker modules. The sides of the arch can be covered with a layer of flat corrugated steel or composite material to reduce damage by light or other weathering of the interior foam.

When used as a replacement for reinforced concrete floors, singular modules of floor panels could be constructed to replace the pouring and heavy weight of reinforced floors in multilevel buildings. The composite arches may be bolted or riveted to the steel superstructure of the building replacing the concrete floor layer reducing construction time because modules could be pre constructed and hoisted into place level by level. the composite arch even with the leveling plate would probably be less than half the total weight.

In an earthquake these module units would not crumble apart as reinforced concrete does during a major earthquake or major accident, pancaking down making survival if occupied rare. The load bearing arch may be able to replace prestressed concrete beams used in crossing open areas or streams. Concrete structures are very fragile and tend to be damaged beyond repair or destroyed during major earthquake or accidents where their base structure is displaced or destroyed. The load bearing arch could withstand movement and even be repaired if damaged during a major earthquake or accident.

The structural plate could be made of other metals such as aluminum or a composite material as fiber-glass or composite recycled plastic panels formed with thickness and corrugations to give them enough resisting stiffness.

The use of connecting structures throughout the structure keeps the upper and lower plates from separating from the interior foam using recycled plastic balls in the interior foam, inclusion of packets of expanding glue for self-repair. In some embodiments, tubes to pass utilities through the arch structure may be installed. A leveling layer makes the structure as flat as possible for floors and traveling surface.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. A load bearing arch, comprising:

a lower arch and an upper arch separated by a first beam and a second beam;

a tension cable extending above the lower arch and between the first beam and the second beam;

one or more levelling plates positioned at a top of the upper arch.

2. The load bearing arch of claim 1, further comprising an interior foam provided within a void.

3. The load bearing arch of claim 2, wherein the void is defined by the space between the lower arch and the upper arch.

4. The load bearing arch of claim 1, wherein the lower arch forms a bottom of the load bearing arch.

5. The load bearing arch of claim 1, further comprising a first beam end plate positioned on the first beam.

6. The load bearing arch of claim 1, further comprising a second beam end plate positioned on the second beam.

7. The load bearing arch of claim 1, further comprising a first beam extension selectively extending from a first upper surface of the first beam.

8. The load bearing arch of claim 1, further comprising a second beam extension selectively extending from a second upper surface of the second beam.

9. A load bearing arch, comprising:

a lower arch and an upper arch separated by a first beam and a second beam;

interior foam provided between the lower arch and the upper arch;

a tension cable extending above the lower arch and between the first beam and the second beam;

one or more levelling plates positioned at a top of the upper arch; and one or more plate ties extending vertically between the lower arch and the upper arch.

10. The load bearing arch of claim 9, wherein the one or more plate ties resist the movement of either plate away from the interior foam.

11. The load bearing arch of claim 10, wherein the interior foam is comprised of a plurality of hollow tubes to allow the passing of a utility.

12. The load bearing arch of claim 11, wherein the lower arch forms a bottom of the load bearing arch.

13. The load bearing arch of claim 12, further comprising a first beam end plate positioned on the first beam.

14. The load bearing arch of claim 13, further comprising a second beam end plate positioned on the second beam.

15. The load bearing arch of claim 14, wherein the first and the second beam end plate include an arch shaped cross sections and are disposed at a constant distance from each other.

16. The load bearing arch of claim 15, further comprising a first beam extension selectively extending from a first upper surface of the first beam.

17. The load bearing arch of claim 16, further comprising a second beam extension selectively extending from a second upper surface of the second beam.

* * * * *